US011155399B2

(12) United States Patent
Yan et al.

(10) Patent No.: US 11,155,399 B2
(45) Date of Patent: Oct. 26, 2021

(54) DUAL-PUMP OUTFLOWING LIQUID CONTAINER

(71) Applicant: SHENZHEN BEAUTY STAR CO., LTD, Guangdong (CN)

(72) Inventors: Debin Yan, Guangdong (CN); Shenzhou Li, Guangdong (CN)

(73) Assignee: SHENZHEN BEAUTY STAR CO., LTD, Shenzhen (CN)

( * ) Notice: Subject to any disclaimer, the term of this patent is extended or adjusted under 35 U.S.C. 154(b) by 0 days.

(21) Appl. No.: 17/160,357

(22) Filed: Jan. 27, 2021

(65) Prior Publication Data

US 2021/0163214 A1 Jun. 3, 2021

Related U.S. Application Data

(63) Continuation of application No. PCT/CN2020/087982, filed on Apr. 30, 2020.

(30) Foreign Application Priority Data

Jul. 19, 2019 (CN) ..... 201910653591.5

(51) Int. Cl.
*B65D 81/32* (2006.01)
*B65D 83/00* (2006.01)
(Continued)

(52) U.S. Cl.
CPC ..... *B65D 83/0072* (2013.01); *B65D 33/01* (2013.01); *B65D 33/08* (2013.01);
(Continued)

(58) Field of Classification Search
CPC ..... B65D 83/0072; B65D 81/3244; B65D 75/5805; B65D 81/3897; B65D 75/008;
(Continued)

(56) References Cited

U.S. PATENT DOCUMENTS 5,169,029 A * 12/1992 Behar ..... B05B 11/3084 128/200.23
5,190,184 A 3/1993 Lechner
(Continued)

FOREIGN PATENT DOCUMENTS

CN 107105862 A 8/2017
KR 101177827 B1 8/2012
(Continued)

*Primary Examiner* — Frederick C Nicolas

(57) ABSTRACT

The present disclosure provides a dual-pump outflowing liquid container, comprising an outer tube, an inner tube and a pump core mechanism, wherein the pump core mechanism includes a pump core mounting seat, the first vacuum pump, the second vacuum pump and a pressing head, the embedding connector is connected to the inner tube embedding mounting hole in a sealing manner, the pump core mounting seat is detachably connected to the top end of the outer tube, the first pump core mounting hole corresponds to the first pump core intercommunication hole, the second pump core mounting hole corresponds to the second pump core intercommunication hole, the pressing head is slidably connected to the pump core mounting seat, a passage inlet of the first outflowing liquid passage is abutting with a pump outlet of the first vacuum pump in a sealing manner.

10 Claims, 14 Drawing Sheets

(51) Int. Cl.

| | |
|---|---|
| ***F04B 39/14*** | (2006.01) |
| ***B65D 75/58*** | (2006.01) |
| ***B65D 33/08*** | (2006.01) |
| ***F04B 41/06*** | (2006.01) |
| ***F04B 39/12*** | (2006.01) |
| ***B65D 41/62*** | (2006.01) |
| ***B65D 33/25*** | (2006.01) |
| ***B65D 33/01*** | (2006.01) |
| ***B65D 75/00*** | (2006.01) |
| ***B65D 81/38*** | (2006.01) |
| ***F04B 37/10*** | (2006.01) |

(52) U.S. Cl.
CPC ..... *B65D 33/2508* (2013.01); *B65D 41/62* (2013.01); *B65D 75/008* (2013.01); *B65D 75/5805* (2013.01); *B65D 81/32* (2013.01); *B65D 81/3244* (2013.01); *B65D 81/3897* (2013.01); *F04B 37/10* (2013.01); *F04B 39/121* (2013.01); *F04B 39/14* (2013.01); *F04B 41/06* (2013.01)

(58) Field of Classification Search
CPC .... B65D 33/01; B65D 33/2508; B65D 33/08; B65D 81/32; B65D 41/62; F04B 41/06; F04B 39/14; F04B 39/121; F04B 37/10
See application file for complete search history.

(56) References Cited

U.S. PATENT DOCUMENTS

| | | | | |
|---|---|---|---|---|
| 5,224,627 | A * | 7/1993 | Weag | B05B 11/3084 222/135 |
| 5,366,115 | A * | 11/1994 | Kersten | B05B 11/047 222/105 |
| 6,082,588 | A * | 7/2000 | Markey | B05B 11/3084 222/135 |
| 7,021,499 | B2 * | 4/2006 | Hansen | A47L 13/00 222/135 |
| 7,875,001 | B2 * | 1/2011 | Minotti | A61M 11/007 604/82 |
| 8,474,659 | B2 * | 7/2013 | Dennis | B05B 15/30 222/137 |
| 9,579,676 | B1 * | 2/2017 | Burrowes | A61L 9/14 |
| 9,687,867 | B2 * | 6/2017 | Burrowes | B05B 11/3084 |
| 10,758,924 | B2 * | 9/2020 | Kang | B05B 11/3081 |
| RE48,427 | E * | 2/2021 | Bruder | B05B 11/3084 |
| 10,918,191 | B2 * | 2/2021 | Kang | A45D 34/06 |
| 2014/0008389 | A1 * | 1/2014 | Mekata | B65D 83/20 222/94 |
| 2014/0263448 | A1 * | 9/2014 | Erskine-Smith | B65D 21/0201 222/143 |
| 2014/0326753 | A1 * | 11/2014 | Turner | B05B 11/3084 222/138 |
| 2017/0065058 | A1 * | 3/2017 | Ki | B65D 47/06 |

FOREIGN PATENT DOCUMENTS

| | | | | |
|---|---|---|---|---|
| KR | 2017003449 U | * | 10/2017 | B65D 81/32 |
| WO | WO-2019124717 A1 | * | 6/2019 | B05B 11/3084 |

* cited by examiner

DUAL-PUMP OUTFLOWING LIQUID CONTAINER

CROSS REFERENCE TO RELATED APPLICATIONS

The present application is a Continuation Application of PCT Application No. PCT/CN2020/087982 filed on Apr. 30, 2020, which claims the benefit of Chinese Patent Application No. 201910653591.5 filed on Jul. 19, 2019. All the above are hereby incorporated by reference in their entirety.

TECHNICAL FIELD

The present disclosure belongs to the technical field of packaging container designs, and in particular to a dual-pump outflowing liquid container.

BACKGROUND

At present, ordinary flexible tubes available on the market discharge liquids by directly squeezing the flexible tubes, there is no quantitation about how much to squeeze, sometimes it is more and sometimes it is less. Some products are used requiring a mixture of two substances; in the prior art, a small flexible tube is sleeved in a big flexible tube, with their outlets aligned to form one squeezing outlet. When in use, the two flexible tubes are squeezed simultaneously, so that the two substances are squeezed from the same squeezing outlet and then are mixed to use. However, the operation of squeezing the two flexible tubes simultaneously is difficult to control the amount of substances squeezed out from the two flexible tubes and it is impossible to achieve precise rationing. Furthermore, when the two squeezed flexible tubes are released, tube bodies of the two flexible tubes can recover automatically under their elastic deformation and then suck back the substances squeezed out, which causes a problem that the mixed substances squeezed out are sucked back to the tubes to lead to a mixing of substances.

SUMMARY

The technical problem to be solved in the present disclosure is to provide a dual-pump outflowing liquid container, aiming to solve the problems in the prior art that the operation of squeezing the two flexible tubes simultaneously is difficult to control the amount of substances squeezed out from the two flexible tubes and that the mixed substances squeezed out are sucked back to the tubes to lead to a mixing of substances.

In order to solve the above technical problem, the present disclosure is implemented in the following way. A dual-pump outflowing liquid container includes: an outer tube, an inner tube and a pump core mechanism; the outer tube has the first pump core intercommunication hole and an inner tube embedding mounting hole, the first pump core intercommunication hole and the inner tube embedding mounting hole are arranged side by side on a top end of the outer tube and are both intercommunicated with the an accommodation space of the outer tube; a top end of the inner tube is provided with an embedding connector, the embedding connector is connected to the inner tube embedding mounting hole in a sealing manner, the embedding connector has the second pump core intercommunication hole, the second pump core intercommunication hole is intercommunicated with an accommodation space of the inner tube, an accommodation gap is provided between an outer wall of the inner tube and an inner wall of the outer tube, the outer tube and the inner tube are both made of flexible materials; the pump core mechanism includes a pump core mounting seat, the first vacuum pump, the second vacuum pump and a pressing head, the pump core mounting seat is detachably connected to the top end of the outer tube, the pump core mounting seat has the first pump core mounting hole and the second pump core mounting hole, the first pump core mounting hole corresponds to the first pump core intercommunication hole, the second pump core mounting hole corresponds to the second pump core intercommunication hole, the first vacuum pump is mounted in the first pump core mounting hole, the second vacuum pump is mounted in the second pump core mounting hole, the first vacuum pump passes through the first pump core intercommunication hole and extends into the accommodation gap, the second vacuum pump passes through the second pump core intercommunication hole and extends into the accommodation space of the inner tube, the pressing head is slidably connected to the pump core mounting seat, the pressing head has the first outflowing liquid passage and the second outflowing liquid passage, a passage inlet of the first outflowing liquid passage is abutting with a pump outlet of the first vacuum pump in a sealing manner, a passage inlet of the second outflowing liquid passage is abutting with a pump outlet of the second vacuum pump in a sealing manner, a passage outlet of the first outflowing liquid passage and a passage outlet of the second outflowing liquid passage are converged to form one liquid outlet.

Further, a fixed ring groove is provided on an inner wall of a passage opening of the inner tube embedding mounting hole, and a ring sealing convex is provided between the passage opening of the inner tube embedding mounting hole and the fixed ring groove, an outer wall of the embedding connector is provided with an assembling convex, the assembling convex is clamped and assembled in the fixed ring groove, the outer wall of the embedding connector abuts against the ring sealing convex, and the embedding connector has a gradually expanding shape in a direction from an end thereof to a bottom end of the inner tube.

Further, an outer wall of the top end of the outer tube has an assembling locating groove that extends along a central axial direction of the outer tube, and an inner wall of the pump core mounting seat is provided with a locating rib that fits with the assembling locating groove to locate.

Further, an inner wall of the pump core mounting seat is provided with a retaining ring convex, a ring step extending inwards is provided on edges of passage openings of both the first pump core mounting hole and the second pump core mounting hole, the outer wall of the top end of the outer tube is provided with a retaining ring mating convex, the first vacuum pump sealing convex extending inwards is provided at the first pump core intercommunication hole, the second vacuum pump sealing convex extending inwards is provided at the second pump core intercommunication hole, the first vacuum pump and the second vacuum pump both have a gradually shrinking shape in a direction from the pump core mounting seat to a bottom end of the outer tube, an outer wall of the first vacuum pump abuts against the first vacuum pump sealing convex, an outer wall of the second vacuum pump abuts against the second vacuum pump sealing convex, both the first vacuum pump and the second vacuum pump are provided with a stop ring, the stop ring of the first vacuum pump abuts against the ring step of the first pump core mounting hole, the stop ring of the second vacuum pump abuts against the ring step of the second pump core mounting hole, and the retaining ring mating convex blocks the retaining ring convex so as to prevent the pump core mounting seat falling off the outer tube.

Further, a central axis of a tube body of the outer tube is arranged coaxially with that of a tube body of the inner tube.

Further, an outer wall of a passage inlet of the first outflowing liquid passage and an outer wall of a passage inlet of the second outflowing liquid passage are both provided with a sealing connection position, and a pump outlet of the first vacuum pump and a pump outlet of the second vacuum pump are both provided with a mating connection position that is tightly sleeved in and in sealing connection with the sealing connection position.

Further, the pressing head is provided with a guide rail which extends along a sliding direction thereof, and the pump core mounting seat has a guide chute that is fit and installed with the guide rail.

Further, a top outer surface of the pressing head is provided with a pressing anti-slip tooth.

Further, the dual-pump outflowing liquid container further includes a cover, an inner wall of the cover has a ring groove, an outer wall of the pump core mounting seat is provided with a plurality of buckle bumps at intervals along a circumferential direction, and each of the plurality of buckle bumps is clamped in the ring groove when the cover is covered on the pump core mounting seat.

Further, the embedding connector is configured to have a cross-section profile of D shape, and an inner wall of the inner tube embedding mounting hole is configured to have a cross-section profile of D shape matching with the embedding connector; or, the embedding connector is configured to have a column shape, and the inner wall of the inner tube embedding mounting hole is configured to have a cross-section profile of circle matching with the embedding connector having a column shape; or, the embedding connector is configured to have a cross-section profile of oval, and the inner tube embedding mounting hole is configured to have a cross-section profile of oval matching with the embedding connector; or, the embedding connector is configured to have a cross-section profile of polygon, and the inner tube embedding mounting hole is configured to have a cross-section profile of polygon matching with the embedding connector.

Compared with the prior art, the present disclosure has the following benefits.

With the dual-pump outflowing liquid container provided in the present disclosure, two substances that are used requiring a mixing can be stored simultaneously. When in use, through one time of pressing of the pressing head, the first vacuum pump and the second vacuum pump can be simultaneously driven to pump out the two substances simultaneously, which are then are mixed and directly used, which greatly facilitates the mixing and usage of the two substances. Moreover, the dual-pump outflowing liquid container will not suck back the liquid substances pumped out and can guarantee a same ratio of liquid substances pumped by the first vacuum pump and the second vacuum pump, thereby achieving a purpose of precise rationing.

DESCRIPTION OF THE EMBODIMENTS

To make the purpose, the technical scheme and the advantages of the present disclosure better understood, the present disclosure is described below in further detail in conjunction with accompanying drawings and embodiments. It should be understood that the specific embodiments described below are merely to illustrate but not to limit the present disclosure.

It is to be noted that when an element is described as "fixed on" or "provided on" another element, it may be directly or indirectly on the another element. When one element is described as "connected to" another element, it may be directly or indirectly connected to the another element.

It should be understood that directional or positional relations indicated by terms such as "length", "width", "upper", "lower", "front", "behind", "left", "right", "vertical", "horizontal", "top", "bottom", "inner", "outer" etc. are directional or positional relations shown based on the drawings, merely to conveniently describe the present disclosure and simplify the description, but not to indicate or imply that the designated device or element must have a specific orientation, be constructed and operated in a specific orientation, therefore cannot be understood as a limitation to the present disclosure.

In addition, terms "first" and "second" are merely for the purpose of description, but cannot be understood as the indication or implication of relative importance or as the implicit indication of the number of the designated technical features. Therefore, features defined by "first" and "second" may explicitly or implicitly include one or more such features. In the description of the present disclosure, unless otherwise clearly and specific stated, "a plurality of" means two or more than two.

The First Embodiment

Figure 1:
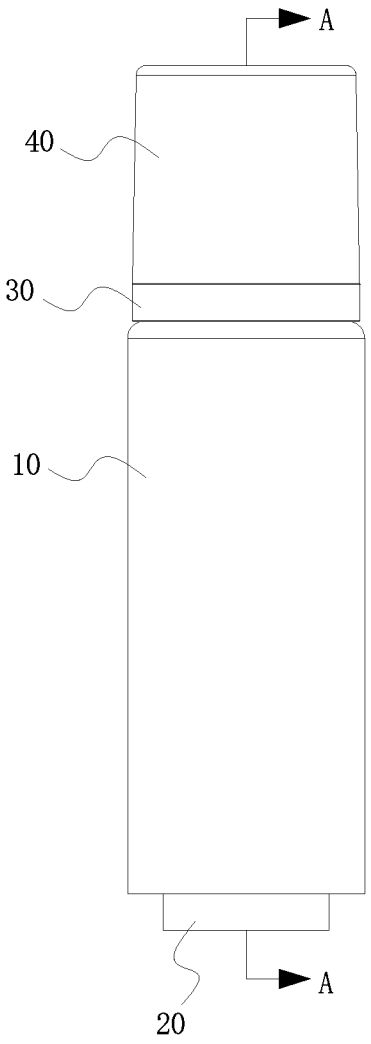
FIG. 1 is an assembly schematic diagram of a dual-pump outflowing liquid container according to the first embodiment of the present disclosure.
Figure 2:
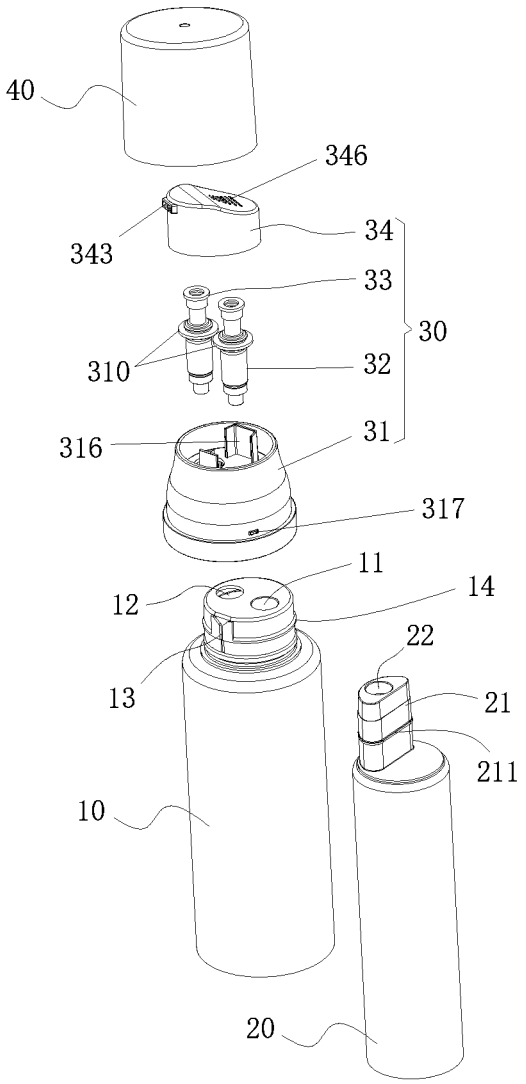
FIG. 2 is an exploded schematic diagram of a dual-pump outflowing liquid container according to the first embodiment of the present disclosure.
Figure 3:
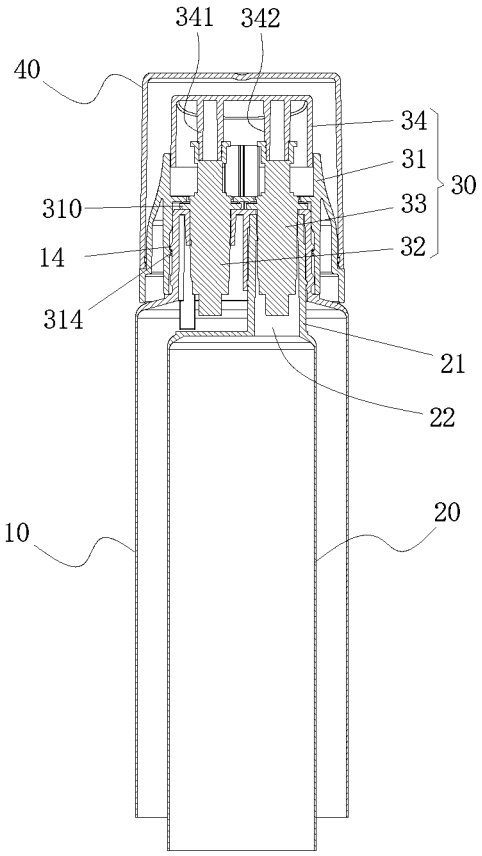
FIG. 3 is a sectional view of FIG. 1 along A-A direction.
Figure 4:
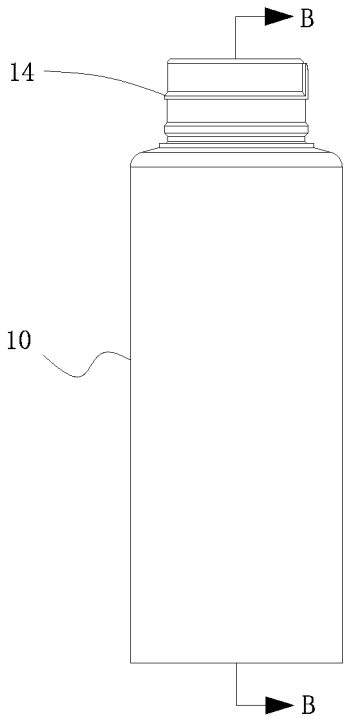
FIG. 4 is a schematic diagram of an outer tube in a dual-pump outflowing liquid container according to the first embodiment of the present disclosure.
Figure 5:
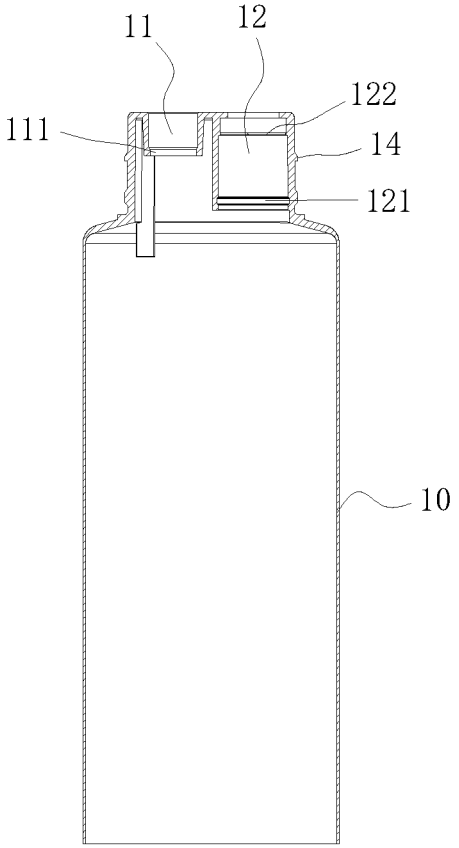
FIG. 5 is a sectional view of FIG. 4 along B-B direction.
Figure 6:
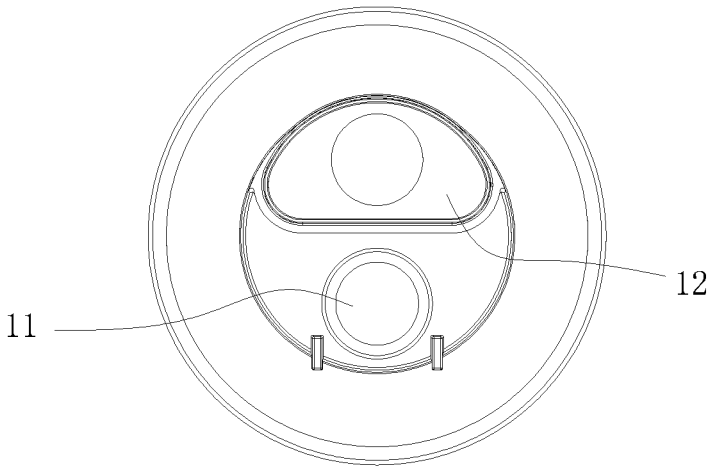
FIG. 6 is a bottom view of an outer tube in FIG. 4 with a bottom uncovered.
Figure 7:
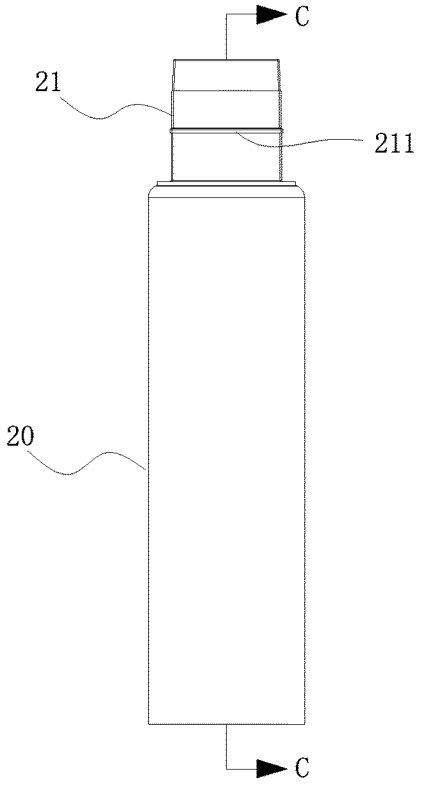
FIG. 7 is a schematic diagram of an inner tube in a dual-pump outflowing liquid container according to the first embodiment of the present disclosure.
Figure 8:
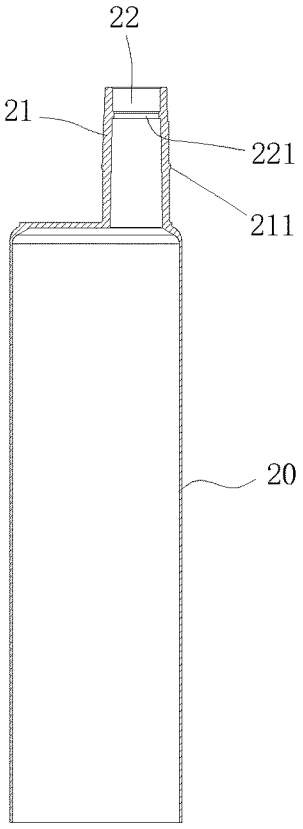
FIG. 8 is a sectional view of FIG. 7 along C-C direction.
Figure 9:
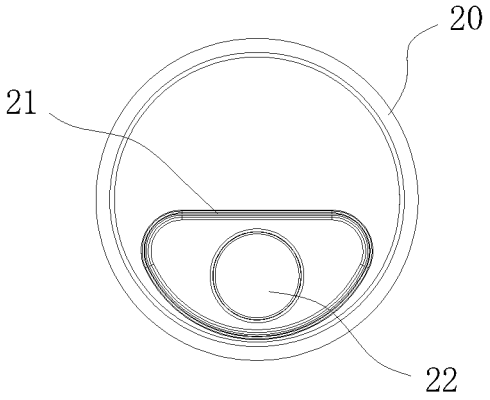
FIG. 9 is a top view of FIG. 7.
Figure 10:
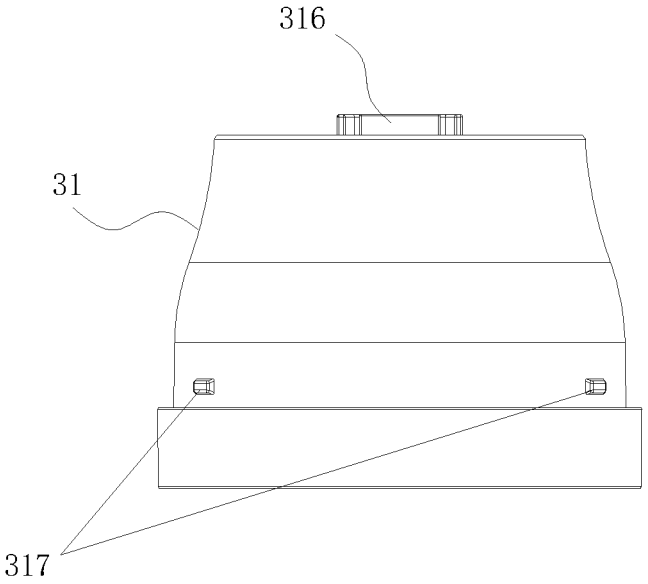
FIG. 10 is a schematic diagram of a pump core mounting seat in a dual-pump outflowing liquid container according to the first embodiment of the present disclosure.

As shown in FIGS. 1 to 3, the dual-pump outflowing liquid container provided in the present disclosure includes an outer tube 10, an inner tube 20 and a pump core mechanism 30. The outer tube 10 has the first pump core intercommunication hole 11 and an inner tube embedding mounting hole 12, the first pump core intercommunication hole 11 and the inner tube embedding mounting hole 12 are arranged side by side on a top end of the outer tube 10 and are both intercommunicated with an accommodation space of the outer tube 10, a top end of the inner tube 20 is provided with an embedding connector 21, the embedding connector 21 is connected to the inner tube embedding mounting hole 12 in a sealing manner, the embedding connector 21 has the second pump core intercommunication hole 22, the second pump core intercommunication hole 22 is intercommunicated with an accommodation space of the inner tube 20, an accommodation gap is provided between an outer wall of the inner tube 20 and an inner wall of the outer tube 10, the outer tube 10 and the inner tube 20 are both made of flexible materials, the pump core mechanism 30 includes a pump core mounting seat 31, the first vacuum pump 32, the second vacuum pump 33 and a pressing head 34, the pump core mounting seat 31 is detachably connected to the top end of the outer tube 10, the pump core mounting seat 31 has the first pump core mounting hole 311 and the second pump core mounting hole 312, the first pump core mounting hole 311 corresponds to the first pump core intercommunication hole 11, the second pump core mounting hole 312 corresponds to the second pump core intercommunication hole 22, the first vacuum pump 32 is mounted in the first pump core mounting hole 311, the second vacuum pump 33 is mounted in the second pump core mounting hole 312, the first vacuum pump 32 passes through the first pump core intercommunication hole 11 and extends into the accommodation gap, the second vacuum pump 33 passes through the second pump core intercommunication hole 22 and extends into the accommodation space of the inner tube 20, the pressing head 34 is slidably connected to the pump core mounting seat 31, the pressing head 34 has the first outflowing liquid passage 341 and the second outflowing liquid passage 342, a passage inlet of the first outflowing liquid passage 341 is abutting with a pump outlet of the first vacuum pump 32 in a sealing manner, a passage inlet of the second outflowing liquid passage 342 is abutting with a pump outlet of the second vacuum pump 33 in a sealing manner, a passage outlet of the first outflowing liquid passage 341 and a passage outlet of the second outflowing liquid passage 342 are converged to form one liquid outlet 343.

When the dual-pump outflowing liquid container provided in the present disclosure is used to store two substances that need to be mixed before normal usage (the two substances cannot be stored after being mixed, for example, some existing common liquid super glue, the two substances can only be stored separately and mixed before usage), the two substances are stored in the accommodate gap and the accommodate space of the inner tube 20 respectively, wherein after the embedding connector 21 of the inner tube 20 is fixedly connected to the inner tube embedding mounting hole 12, a tube body of the inner tube 20 is partially accommodated in the accommodation space of the outer tube 10 to form an accommodation gap. During the usage process, a user presses the pressing head 34 of the dual-pump outflowing liquid container so that the pressing head 34 slides on the pump core mounting seat 31, thereby driving the first vacuum pump 32 and the second vacuum pump 33 to work; the first vacuum pump 32 pumps out a liquid substance stored in the accommodation gap through the first outflowing liquid passage 341, meanwhile the second vacuum pump 33 pumps out a liquid substance stored in the accommodation space of the inner tube 20 through the second outflowing liquid passage 342; then, two liquid substances are converged at the liquid outlet 343 and pumped out for use after being mixed. With the dual-pump outflowing liquid container provided in the present disclosure, two substances that are used requiring a mixture thereof can be stored simultaneously. When in use, the first vacuum pump 32 and the second vacuum pump 33 can be simultaneously driven by pressing the pressing head 34 once to pump out the two substances simultaneously, and the two substances are mixed and then directly used, which greatly facilitates the mixing and usage of the two substances. Moreover, the first vacuum pump 32 and the second vacuum pump 33 are used to pump substances, in such a way that the amount of substances pumped out each time remains the same, that is, the proportion of respective liquid substances pumped out through the first vacuum pump 32 and the second vacuum pump 33 have a same ratio after pressing the pressing head 34 each time, thereby achieving a purpose of precise rationing. Furthermore, since the first vacuum pump 32 and the second vacuum pump 33 are used to pump the two substances respectively, and the vacuum pump does not suck back the liquid substance pumped out, which completely eliminates the problem that the mixed substances squeezed out are sucked back to the tubes to lead to a mixing of substances, compared with the prior art.

Figure 17:
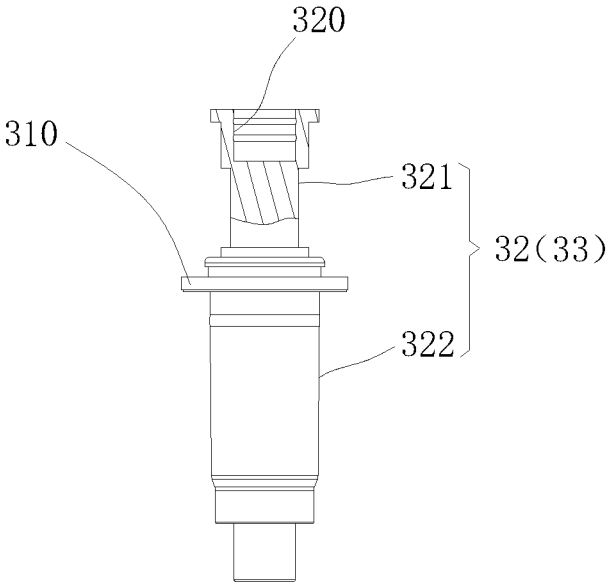
FIG. 17 is a partial sectional view of a pump core in a dual-pump outflowing liquid container according to the first embodiment of the present disclosure.
Figure 18:
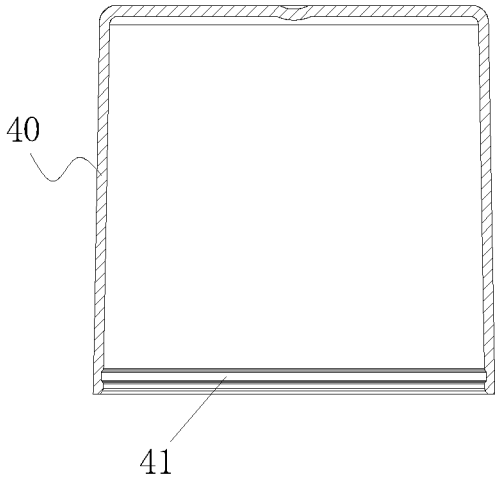
FIG. 18 is a sectional view of a cover in a dual-pump outflowing liquid container according to the first embodiment of the present disclosure along a symmetric plane thereof.
Figure 19:
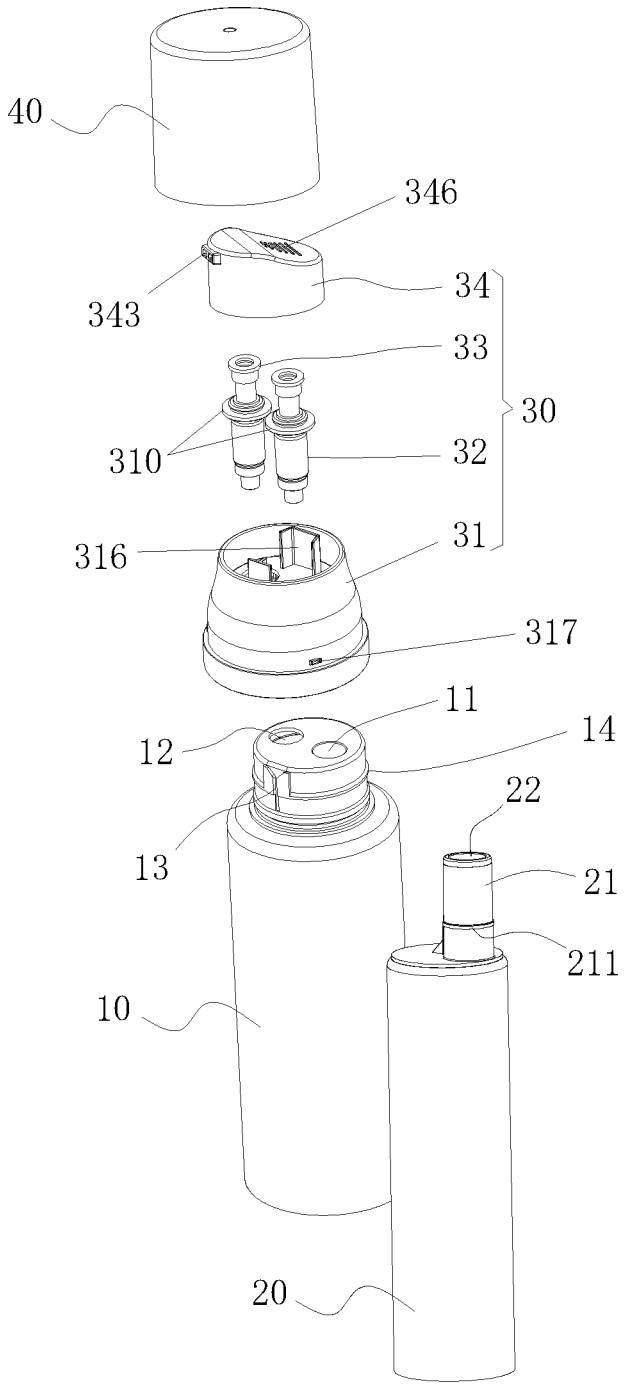
FIG. 19 is an exploded schematic diagram of a dual-pump outflowing liquid container according to the second embodiment of the present disclosure.
Figure 20:
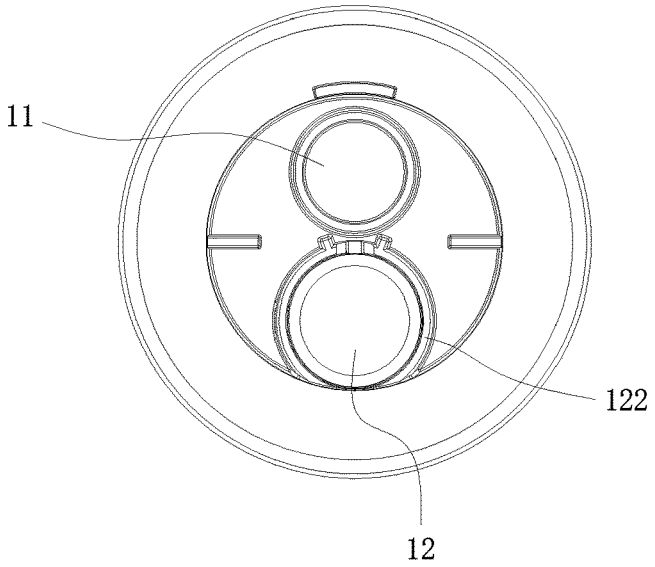
FIG. 20 is a bottom view of an outer tube in a dual-pump outflowing liquid container according to the second embodiment of the present disclosure, with a bottom uncovered.
Figure 21:
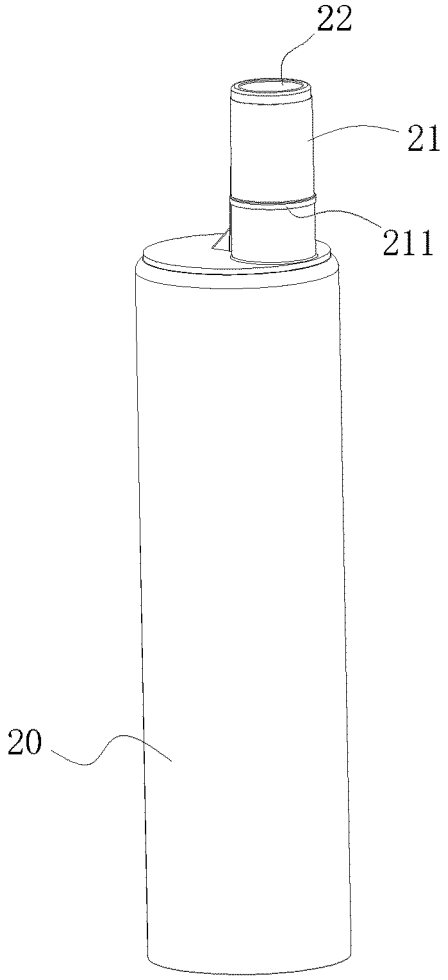
FIG. 21 is a schematic diagram of an inner tube in a dual-pump outflowing liquid container according to the second embodiment of the present disclosure.
Figure 22:
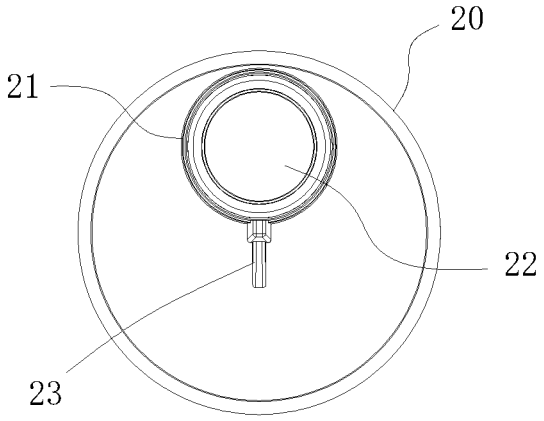
FIG. 22 is a top view of FIG. 21.

In the present disclosure, the first vacuum pump 32 and the second vacuum pump 33 both adopt the vacuum pumps widely used and mature in the prior art, therefore, the first vacuum pump 32 and the second vacuum pump 33 adopted in the present disclosure can be directly purchased from the market; moreover, respective pump outputs of the first vacuum pump 32 and the second vacuum pump 33 are selected according to a precise quantitative ratio of specific requirements, for example, if the two substances have a ratio of 1:3, then a ratio of the pump output of the first vacuum pump 32 to that of the second vacuum pump 33 is 1:3. Therefore, the first vacuum pump 32 and the second vacuum pump 33 are neither limited to have the same pump output, nor limited to have the same model number. Specifically, as shown in FIG. 17, taking the first vacuum pump 32 as an example, the first vacuum pump 32 includes a pump core driving part 321 and a pump core fixing part 322, and the pump core driving part 321 is assembled to the pump core fixing part 322 using a compression spring (not shown in the drawings), in such a way that the compression spring is further compressed after the pump core driving part 321 is pressed, then the pump core driving part 321 can be reset relative to the pump core fixing part 322 under the elastic force of the compression spring. During the process of the pump core driving part 321 being supporting to reset by the compression spring, a vacuum accommodation space is formed between the pump core driving part 321 and the pump core fixing part 322, in such a way that a negative pressure is formed in the accommodation space of both the outer tube 10 and the inner tube 20; meanwhile, since the outer tube 10 and the inner tube 20 are both made of flexible materials easy to deform, the external atmosphere is transmitted without obstruction, through the natural deformation of the flexible tube body, to one of the liquid substances in the accommodation gap and the other liquid substance in the inner tube 20, and then, through pressure difference, the two liquid substances are respectively pumped into the vacuum accommodation space between the pump core driving part 321 and the pump core fixing part 322 of the first vacuum pump 32 and the vacuum accommodation space between the pump core driving part 321 and the pump core fixing part 322 of the second vacuum pump 33, and when the pressing head 34 is pressed, the liquid substance in the vacuum accommodation space can be pumped out.

Moreover, after the embedding connector 21 of the inner tube 20 is connected to the inner tube embedding mounting hole 12, the tube body of the inner tube 20 is located in the accommodation space of the outer tube 10, and a central axis of a tube body of the outer tube 10 is arranged coaxially with that of the tube body of the inner tube 20, which guarantees that the accommodation gap formed between the outer tube 10 and the inner tube 20 has enough space to store the liquid substance and makes the pressure of the pressure difference transmitted from the external atmosphere to the inner tube 20 more uniform.

Figure 12:
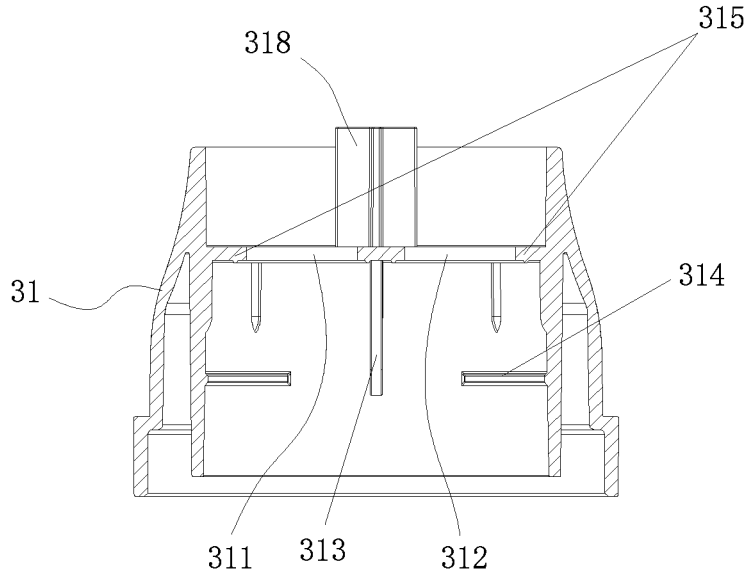
FIG. 12 is a sectional view of FIG. 11 along D-D direction.
Figure 13:
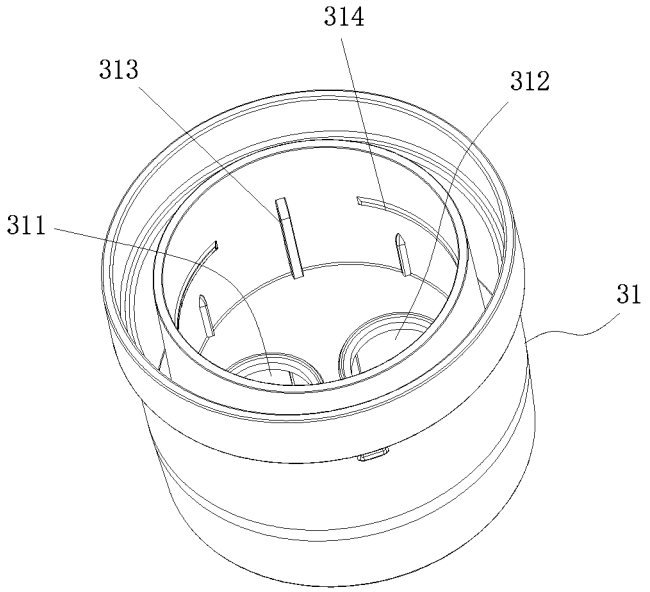
FIG. 13 is an axonometric view of the pump core mounting seat in FIG. 11 from another angle.

As shown in FIG. 2, an outer wall of the top end of the outer tube 10 is provided with an assembling locating groove 13 that extends along a central axial direction of the outer tube 10, meanwhile, as shown in FIG. 12, an inner wall of the pump core mounting seat 31 is provided with a locating rib 313 that fits with the assembling locating groove 13 to locate. During the process of assembling the pump core mounting seat 31 on the outer tube 10, it is only needed to make the locating rib 313 aligned to and fit with the assembling locating groove 13, which realizes fast locating and correct installation of the pump core mounting seat 31.

As shown in FIG. 4, FIG. 5, FIG. 7, FIG. 8, FIG. 12 and FIG. 13, an inner wall of the pump core mounting seat 31 is provided with a retaining ring convex 314, a ring step 315 extending inwards is provided on edges of passage openings of both the first pump core mounting hole 311 and the second pump core mounting hole 312, the outer wall of the top end of the outer tube 10 is provided with a retaining ring mating convex 14, the first vacuum pump sealing convex 111 extending inwards is provided at the first pump core intercommunication hole 11, the second vacuum pump sealing convex 221 extending inwards is provided at the second pump core intercommunication hole 22, through the cooperation between the retaining ring convex 314, the ring step 315, the retaining ring mating convex 14, the first vacuum pump sealing convex 111 and the second vacuum pump sealing convex 221, a purpose of firm assembly is realized. The pump core fixing part 322 of the first vacuum pump 32 and the pump core fixing part 322 of the second vacuum pump 33 both have a gradually shrinking shape in a direction from the pump core mounting seat 31 to a bottom end of the outer tube 10; an outer wall of the first vacuum pump 32 abuts against the first vacuum pump sealing convex 111, and an outer wall of the second vacuum pump 33 abuts against the second vacuum pump sealing convex 221, which enables the first vacuum pump 32 and the second vacuum pump 33 to form a good sealing performance after the assembly is completed; moreover, the pump core fixing part 322 having a gradually shrinking shape performs mounting and positioning while forming an abutment with the first vacuum pump sealing convex 111 and the second vacuum pump sealing convex 221. As shown in FIG. 2, the pump core fixing parts 322 of both the first vacuum pump 32 and the second vacuum pump 33 are provided with a stop ring 310, the stop ring 310 of the first vacuum pump 32 abuts against the ring step 315 of the first pump core mounting hole 311, the stop ring 310 of the second vacuum pump 33 abuts against the ring step 315 of the second pump core mounting hole 312, which cooperates with the pump core fixing parts 322 having a gradually shrinking shape, meanwhile the pump core fixing parts 322 are inserted into and abut against the first vacuum pump sealing convex 111 and the second vacuum pump sealing convex 221, therefore, the first vacuum pump 32 and the second vacuum pump 33 can be stabilized in the pump core mounting seat 31, then the retaining ring mating convex 14 blocks the retaining ring convex 314 so as to prevent the pump core mounting seat 31 falling off the outer tube 10.

During the process of mounting the pump core mechanism 30 to the top end of the outer tube 10, firstly, the first vacuum pump 32 and the second vacuum pump 33 are placed in the first pump core intercommunication hole 11 and the second pump core intercommunication hole 22, then the pump core mounting seat 31 is covered on the top end of the outer tube 10, in such a way that the locating rib 313 is aligned to the assembling locating groove 13, and the first pump core mounting hole 311 and the second pump core mounting hole 312 are aligned to the pump core driving parts 321 of the first vacuum pump 32 and the second vacuum pump 33 respectively, and finally the pump core mounting seat 31 is pressed down with a force, and the assembly is finished when the retaining ring convex 314 crosses the retaining ring mating convex 14. At such time, as shown in FIG. 3, the stop ring 310 abuts against the ring step 315; further, a ring silicon washer may be placed between the stop ring 310 and the ring step 315, meanwhile, ring silicon washers are placed between the stop ring 310 and the first pump core intercommunication hole 11/the second pump core intercommunication hole 22, and the ring silicon washers are squeezed and deformed in the process of closing the pump core mounting seat 31, thus the assembly is finished more stably and compactly. Finally, the pressing head 34 is abutting with the first vacuum pump 32 and the second vacuum pump 33 and completes a sliding fit connection with the pump core mounting seat 31, then the mounting process of the pump core mechanism 30 is completed.

Figure 11:
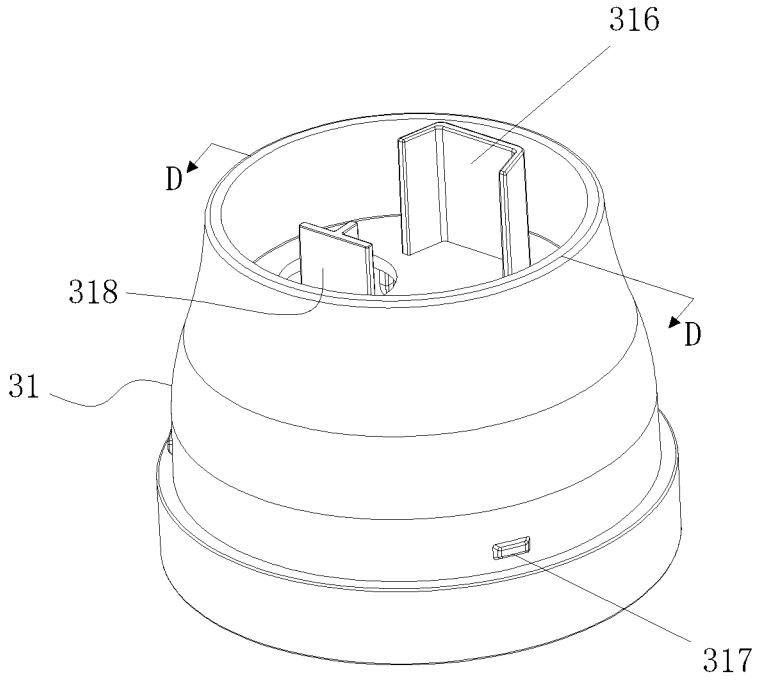
FIG. 11 is an axonometric view of a pump core mounting seat in a dual-pump outflowing liquid container according to the first embodiment of the present disclosure.
Figure 14:
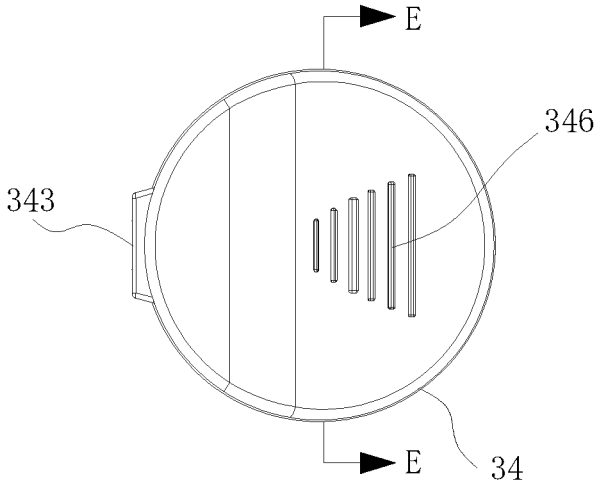
FIG. 14 is a top view of a pressing head in a dual-pump outflowing liquid container according to the first embodiment of the present disclosure.
Figure 15:
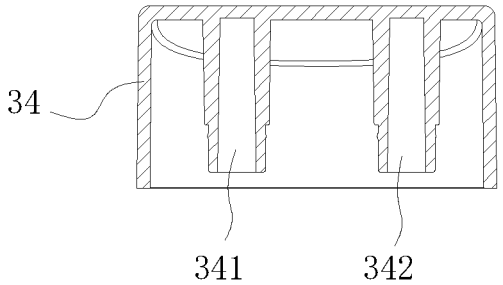
FIG. 15 is a sectional view of FIG. 14 along E-E direction.
Figure 16:
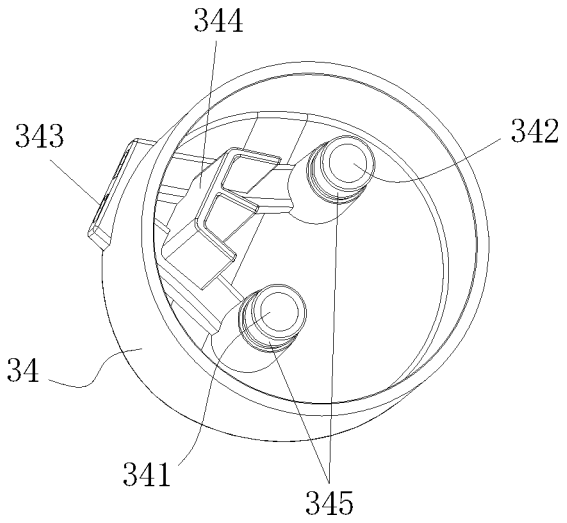
FIG. 16 is an axonometric view of a pressing head from a bottom view angle.

Specifically, as shown in FIGS. 14 to 17, an outer wall of a passage inlet of the first outflowing liquid passage 341 and an outer wall of a passage inlet of the second outflowing liquid passage 342 are both provided with a sealing connection position 345, and a pump outlet of the first vacuum pump 32 and a pump outlet of the second vacuum pump 33 are both provided with a mating connection position 320 that is tightly sleeved in and in sealing connection with the sealing connection position 345. Moreover, as shown in FIG. 11 and FIG. 16, the pressing head 34 is provided with a guide rail 344 which extends along a sliding direction thereof, and the pump core mounting seat 31 has a guide chute 316 that is fit and installed with the guide rail 344. During the process of assembling the pressing head 34, firstly, the guide rail 344 and the guide chute 316 must be aligned, then ends of the first outflowing liquid passage 341 and the second outflowing liquid passage 342 are aligned to the pump core driving part 321 of the first vacuum pump 32 and the pump core driving part 321 of the second vacuum pump 33 respectively, and finally the pressing head 34 is pressed down with a force, in such a way that the sealing connection position 345 and the mating connection position 320 are connected to form good sealing. As shown in FIG. 14, a top outer surface of the pressing head 34 is provided with a pressing anti-slip tooth 346. When it is needed to use the two substances, a user presses the pressing head 34 aiming at the pressing anti-slip tooth 346, then the pressing head 34 slides under a guide cooperation of the guide rail 344 and the guide chute 316, thereby driving the pump core driving parts 321 of the first vacuum pump 32 and the second vacuum pump 33 to press down to realize pumping. When the pressing head 34 is pressed to the lowest position (at this time, both the two substances have a maximum pump output, and the two substances have the same maximum pump output), a top inner wall of the pressing head 34 is supported by a T shaped block 318, which limits the maximum pump outputs of the two substances pumped out through the first vacuum pump 32 and the second vacuum pump 33 driven by the pressing head 34. Then, the user releases the pressing head 34, under the elastic force of the compression spring, the pump core driving part 321 drives the pressing head 34 to reset.

As shown in FIGS. 4 to 9, a fixed ring groove 121 is provided on an inner wall of a passage opening of the inner tube embedding mounting hole 12, and a ring sealing convex 122 is provided between the passage opening of the inner tube embedding mounting hole 12 and the fixed ring groove 121, an outer wall of the embedding connector 21 is provided with an assembling convex 211, the assembling convex 211 is clamped and assembled in the fixed ring groove 121, the outer wall of the embedding connector 21 abuts against the ring sealing convex 122, and the embedding connector 21 has a gradually expanding shape in a direction from an end thereof to a bottom end of the inner tube 20. When assembling the outer tube 10 and the inner tube 20, a bottom of the outer tube 10 is uncovered first, then the inner tube 20 is extended into the outer tube 10 from the bottom of the outer tube 10, next, the embedding connector 21 is aligned to the inner tube embedding mounting hole 12, and the inner tube 20 is pushed into the outer tube 10 with a force in such a way that the assembling convex 211 is squeezed into and assembled with the fixed ring groove 121, at this time, the outer wall of the embedding connector 21 having a gradually expanding shape in the direction from the end thereof to the bottom end of the inner tube 20 is in tight fitting with the ring sealing convex 122 to form sealing, thereby fixing the inner tube 20 to the outer tube 10. In actual design, in order to more reasonably use space and to prevent the inner tube 20 rotating after connected to the outer tube 10, the embedding connector 21 is designed to have a cross-section profile of D shape, correspondingly, an inner wall of the inner tube embedding mounting hole 12 is also designed to have a cross-section profile of D shape.

In the dual-pump outflowing liquid container provided in the present disclosure, as shown in FIGS. 1 to 3, FIG. 10, FIG. 11 and FIG. 18, the dual-pump outflowing liquid container further includes a cover 40, an inner wall of the cover 40 is provided with a ring groove 41, an outer wall of the pump core mounting seat 31 is provided with a plurality of buckle bumps 317 at intervals in a circumferential direction, and each of the plurality of buckle bumps 317 is clamped in the ring groove 41 when the cover 40 is covered on the pump core mounting seat 31. When not using the substance stored in the container, the cover 40 can protect the liquid outlet 343 when covered on the pump core mounting seat 31, thereby preventing impurities and dust entering the first outflowing liquid passage 341 and the second outflowing liquid passage 342 to contaminate the substances pumped out or clog the first outflowing liquid passage 341 and the second outflowing liquid passage 342.

During the production process using the dual-pump outflowing liquid container, the inner tube 20 is firstly assembled into the outer tube 10, then the first vacuum pump 32 and the second vacuum pump 33 are assembled, at this time the bottoms of both the outer tube 10 and the inner tube 20 are not covered, next, the first liquid substance is injected into the accommodation gap from the bottom of the outer tube 10 and meanwhile the second liquid substance is injected from the bottom of the inner tube 20, and finally the bottom of the inner tube 20 is sealed and the bottom of the outer tube 10 is sealed (where the bottom of the inner tube 20 is exposed out of the outer tube 10, as shown in FIGS. 1 to 3, at this time, the accommodation gap is firstly filled with the first liquid substance and the bottom of the outer tube 10 is sealed, and then the accommodation space of the inner tube 20 is filled with the second liquid substance and the bottom of the inner tube 20 is sealed). Finally the cover 40 is covered on and a product is packaged, that is, the whole production process is completed.

The Second Embodiment

In the second embodiment, as shown in FIGS. 19 to 22, the embedding connector 21 is designed to have a column shape, correspondingly the inner wall of the inner tube embedding mounting hole 12 is designed to have a cross-section profile of circle matching with the embedding connector 21 having a column shape. When the embedding connector 21 having a column shape is mounted to the inner tube embedding mounting hole 12, in order to prevent the inner tube 20 rotating relative to the outer tube 10 during the usage process, a reinforcement locating rib 23 is provided on the outer wall of the embedding connector 21 having a column shape, and an anti-rotating locating groove matching with the reinforcement locating rib 23 is provided on the inner wall of the inner tube embedding mounting hole 12; during assembly process, the reinforcement locating rib 23 is aligned to the anti-rotating locating groove, and then the embedding connector 21 is pushed into the inner tube embedding mounting hole 12 with a force.

In addition, the embedding connector 21 in the present disclosure can also be designed to have a cross-section profile of polygon, preferably regular polygon, for example, regular triangle, square, regular pentagon and regular hexagon; correspondingly, the inner tube embedding mounting hole 12 is designed to have a cross-section profile of polygon matching with the embedding connector 21. The embedding connector 21 in the present disclosure can also be designed to have a cross-section profile of oval, and the inner tube embedding mounting hole 12 is designed to have a cross-section profile of oval matching with the embedding connector 21. When the embedding connector 21 is designed to have a cross-section profile of polygon or oval, an adaptive anti-rotating mating structure is formed between the embedding connector 21 having a cross-section profile of oval and the inner tube embedding mounting hole 12 matching with the embedding connector 21 having a cross-section profile of oval; therefore, it is not necessary to provide the reinforcement locating rib 23 as described in the second embodiment on the outer wall of the embedding connector 21 and the anti-rotating locating groove matching with the reinforcement locating rib 23 on the inner wall of the inner tube embedding mounting hole 12; except the above differences, other structure design is of the same.

Except the above structure, the second embodiment has the same structure as the first embodiment. No further description is needed here.

The Third Embodiment

Figure 23:
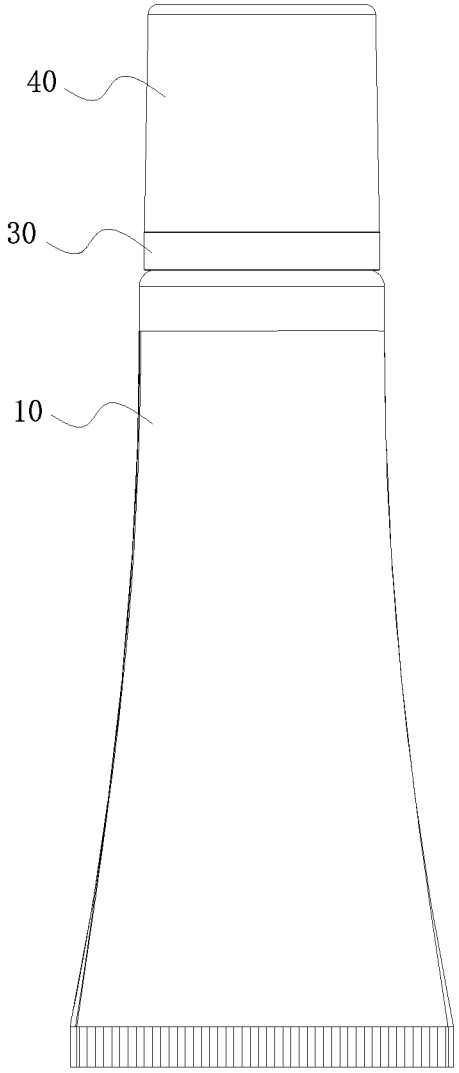
FIG. 23 is a front view of an assembly structure of a dual-pump outflowing liquid container according to the third embodiment of the present disclosure.
Figure 24:
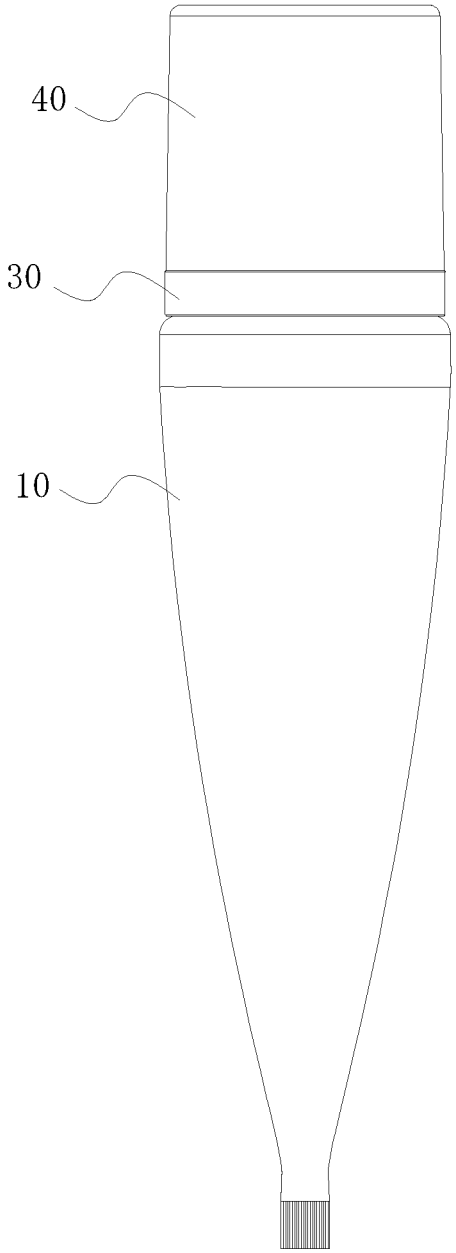
FIG. 24 is a left view of FIG. 23.

In the third embodiment, the bottom of the inner tube 20 is completely wrapped in the accommodation space of the outer tube 10, the accommodation space of the inner tube 20 is firstly filled with one liquid substance and the bottom of the inner tube 20 is sealed, then the accommodation gap is filled with the other liquid substance, and finally the bottom of the outer tube 10 is sealed. In the third embodiment, since the outer tube 10 and the inner tube 20 are both made of flexible materials easy to deform, hot melt sealing is adopted when sealing the bottoms of the outer tube 10 and the inner tube 20, as shown in FIG. 23 and FIG. 24, the bottoms of both the outer tube 10 and the inner tube 20 after sealing have a fishtail shape. Preferably, in the third embodiment, the bottoms of the outer tube 10 and the inner tube 20 can be processed with hot melt sealing simultaneously, that is, after the hot melt sealing, there is only one hot melt joint in a bottom joint of the outer tube 10 and the inner tube 20. Moreover, when the bottoms of the outer tube 10 and the inner tube 20 are processed with hot melt sealing simultaneously, the accommodation space of the inner tube 20 and the accommodation gap can be filled with two liquid substances simultaneously, and then the bottoms are processed with hot melt sealing simultaneously.

Except the above structure, the third embodiment has the same structure as the first embodiment and the second embodiment. No further description is needed here.

The above are merely the preferred embodiments of the present disclosure and are not intended to limit the present disclosure. Any modification, equivalent substitute and improvement made within the principle of the present disclosure are intended to be included within the scope of protection of the present disclosure.

Description of reference signs in the accompanying drawings:

10 represents an outer tube, 11 represents a first pump core intercommunication hole, 111 represents a first vacuum pump sealing convex, 12 represents an inner tube embedding mounting hole, 121 represents a fixed ring groove, 122 represents a ring sealing convex, 13 represents an assembling locating groove, 14 represents a retaining ring mating convex, 20 represents an inner tube, 21 represents an embedding connector, 211 represents an assembling convex, 22 represents a second pump core intercommunication hole, 221 represents a second vacuum pump sealing convex, 23 represents a reinforcement locating rib, 30 represents a pump core mechanism, 31 represents a pump core mounting seat, 311 represents a first pump core mounting hole, 312 represents a second pump core mounting hole, 313 represents a locating rib, 314 represents a retaining ring convex, 315 represents a ring step, 316 represents a guide chute, 317 represents a buckle bump, 318 represents a T shaped block, 32 represents a first vacuum pump, 33 represents a second vacuum pump, 34 represents a pressing head, 341 represents a first outflowing liquid passage, 342 represents a second outflowing liquid passage, 343 represents a liquid outlet, 344 represents a guide rail, 345 represents a sealing connection position, 346 represents a pressing anti-slip tooth, 310 represents a stop ring, 320 represents a mating connection position, 40 represents a cover, 41 represents a ring groove, 321 represents a pump core driving part, and 322 represents a pump core fixing part.

What is claimed is:

1. A dual-pump outflowing liquid container, comprising:

an outer tube, having a first pump core intercommunication hole and an inner tube embedding mounting hole, wherein the first pump core intercommunication hole and the inner tube embedding mounting hole are arranged side by side on a top end of the outer tube and are both intercommunicated with an accommodation space of the outer tube;

an inner tube, wherein a top end of the inner tube is provided with an embedding connector, the embedding connector is connected to the inner tube embedding mounting hole in a sealing manner, the embedding connector has a second pump core intercommunication hole, the second pump core intercommunication hole is intercommunicated with an accommodation space of the inner tube, an accommodation gap is provided between an outer wall of the inner tube and an inner wall of the outer tube, both the outer tube and the inner tube are made of flexible materials; and a pump core mechanism, including a pump core mounting seat, a first vacuum pump, a second vacuum pump and a pressing head, wherein the pump core mounting seat is detachably connected to the top end of the outer tube, the pump core mounting seat has a first pump core mounting hole and a second pump core mounting hole, the first pump core mounting hole corresponds to the first pump core intercommunication hole, the second pump core mounting hole corresponds to the second pump core intercommunication hole, the first vacuum pump is mounted in the first pump core mounting hole, the second vacuum pump is mounted in the second pump core mounting hole, the first vacuum pump passes through the first pump core intercommunication hole and extends into the accommodation gap, the second vacuum pump passes through the second pump core intercommunication hole and extends into the accommodation space of the inner tube, the pressing head is slidably connected to the pump core mounting seat, the pressing head has a first outflowing liquid passage and a second outflowing liquid passage, a passage inlet of the first outflowing liquid passage is abutting with a pump outlet of the first vacuum pump in a sealing manner, a passage inlet of the second outflowing liquid passage is abutting with a pump outlet of the second vacuum pump in a sealing manner, a passage outlet of the first outflowing liquid passage and a passage outlet of the second outflowing liquid passage are converged to form one liquid outlet.

2. The dual-pump outflowing liquid container according to claim 1, wherein a fixed ring groove is provided on an inner wall of a passage opening of the inner tube embedding mounting hole, and a ring sealing convex is provided between the passage opening of the inner tube embedding mounting hole and the fixed ring groove, an outer wall of the embedding connector is provided with an assembling convex, the assembling convex is clamped and assembled in the fixed ring groove, the outer wall of the embedding connector abuts against the ring sealing convex, and the embedding connector has a gradually expanding shape in a direction from an end thereof to a bottom end of the inner tube.

3. The dual-pump outflowing liquid container according to claim 1, wherein an outer wall of the top end of the outer tube is provided with an assembling locating groove that extends along a central axial direction of the outer tube, and an inner wall of the pump core mounting seat is provided with a locating rib that fits with the assembling locating groove to locate.

4. The dual-pump outflowing liquid container according to claim 3, wherein an inner wall of the pump core mounting seat is provided with a retaining ring convex, a ring step extending inwards is provided on edges of passage openings of both the first pump core mounting hole and the second pump core mounting hole, the outer wall of the top end of the outer tube is provided with a retaining ring mating convex, a first vacuum pump sealing convex extending inwards is provided at the first pump core intercommunication hole, a second vacuum pump sealing convex extending inwards is provided at the second pump core intercommunication hole, both the first vacuum pump and the second vacuum pump have a gradually shrinking shape in a direction from the pump core mounting seat to a bottom end of the outer tube, an outer wall of the first vacuum pump abuts against the first vacuum pump sealing convex, and an outer wall of the second vacuum pump abuts against the second vacuum pump sealing convex, both the first vacuum pump and the second vacuum pump are provided with a stop ring, the stop ring of the first vacuum pump abuts against the ring step of the first pump core mounting hole, the stop ring of the second vacuum pump abuts against the ring step of the second pump core mounting hole, and the retaining ring mating convex blocks the retaining ring convex to prevent the pump core mounting seat falling off the outer tube.

5. The dual-pump outflowing liquid container according to claim 1, wherein a central axis of a tube body of the outer tube is arranged coaxially with that of a tube body of the inner tube.

6. The dual-pump outflowing liquid container according to claim 1, wherein both an outer wall of a passage inlet of the first outflowing liquid passage and an outer wall of a passage inlet of the second outflowing liquid passage are provided with a sealing connection position, and both a pump outlet of the first vacuum pump and a pump outlet of the second vacuum pump are provided with a mating connection position tightly sleeved in and in sealing connection with the sealing connection position.

7. The dual-pump outflowing liquid container according to claim 1, wherein the pressing head has a guide rail which extends along a sliding direction thereof, and the pump core mounting seat has a guide chute that is fit and installed with the guide rail.

8. The dual-pump outflowing liquid container according to claim 7, wherein a top outer surface of the pressing head is provided with a pressing anti-slip tooth.

9. The dual-pump outflowing liquid container according to claim 1, wherein the dual-pump outflowing liquid container further comprises a cover, an inner wall of the cover is provided with a ring groove, an outer wall of the pump core mounting seat is provided with a plurality of buckle bumps at intervals in a circumferential direction, and each of the plurality of buckle bumps is clamped in the ring groove when the cover is covered on the pump core mounting seat.

10. The dual-pump outflowing liquid container according to claim 1, wherein the embedding connector is configured to have a cross-section profile of D shape, and an inner wall of the inner tube embedding mounting hole is configured to have a cross-section profile of D shape matching with the embedding connector;

or the embedding connector is configured to have a column shape, and the inner wall of the inner tube embedding mounting hole is configured to have a cross-section profile of circle matching with the embedding connector having a column shape;

or the embedding connector is configured to have a cross-section profile of oval, and the inner tube embedding mounting hole is configured to have a cross-section profile of oval matching with the embedding connector;

or the embedding connector is configured to have a cross-section profile of polygon, and the inner tube embedding mounting hole is configured to have a cross-section profile of polygon matching with the embedding connector.

* * * * *